US012648637B2

(12) United States Patent
Barker et al.

(10) Patent No.: US 12,648,637 B2
(45) Date of Patent: Jun. 9, 2026

(54) ADJUSTABLE FLOATING SHELF

(71) Applicant: Murphy Door Inc., West Haven, UT (US)

(72) Inventors: Jeremy Barker, West Haven, UT (US); Robert Charles Cooley, West Haven, UT (US)

( * ) Notice: Subject to any disclaimer, the term of this patent is extended or adjusted under 35 U.S.C. 154(b) by 0 days.

(21) Appl. No.: 18/799,634

(22) Filed: Aug. 9, 2024

(65) Prior Publication Data

US 2025/0049210 A1 Feb. 13, 2025

Related U.S. Application Data

(60) Provisional application No. 63/518,759, filed on Aug. 10, 2023.

(51) Int. Cl.

*A47B 57/26* (2006.01)
*A47B 45/00* (2006.01)
*A47B 57/58* (2006.01)

(52) U.S. Cl.

CPC ..... *A47B 57/586* (2013.01); *A47B 45/00* (2013.01); *A47B 57/26* (2013.01)

(58) Field of Classification Search

CPC ..... A47B 57/586; A47B 45/00; A47B 57/26; A47B 96/066; A47B 96/028; A47B 96/061

See application file for complete search history.

(56) References Cited

U.S. PATENT DOCUMENTS

| | | | | | |
|---|---|---|---|---|---|
| 2,843,729 | A * | 7/1958 | Materese | B60Q 3/43 | 362/544 |
| 3,527,175 | A * | 9/1970 | Kapnek | A47B 5/02 | 108/152 |
| 3,976,200 | A * | 8/1976 | Munns | B62H 3/12 | 211/100 |
| 5,769,520 | A * | 6/1998 | Jun | F25D 25/02 | 211/88.01 |
| 5,857,577 | A * | 1/1999 | Thomas | A47B 96/061 | 211/94.01 |
| 6,164,610 | A * | 12/2000 | Santiago | A47B 96/022 | 211/90.01 |
| 6,637,605 | B2 * | 10/2003 | Ernst | B25H 3/003 | 206/378 |
| 7,198,158 | B2 * | 4/2007 | Kao | A47F 5/083 | 211/70.6 |
| 7,669,723 | B2 * | 3/2010 | Kao | B25H 3/04 | 206/349 |
| 8,182,056 | B2 * | 5/2012 | Gossens | A47B 96/061 | 312/408 |
| 9,918,568 | B1 * | 3/2018 | Blake | A47G 25/0678 | |
| 10,575,641 | B1 * | 3/2020 | Severa | A47B 96/061 | |
| 11,596,230 | B2 * | 3/2023 | Horezga | A47B 96/061 | |
| 11,825,946 | B1 * | 11/2023 | Anderson | A47B 96/066 | |
| 12,011,088 | B2 * | 6/2024 | Anderson | A47B 96/061 | |
| 12,137,805 | B2 * | 11/2024 | Anderson | A47B 96/066 | |
| 12,144,424 | B2 * | 11/2024 | Anderson | A47B 96/066 | |
| 12,201,216 | B2 * | 1/2025 | LeBlanc | A47B 96/061 | |

(Continued)

*Primary Examiner* — Nkeisha Smith

(57) ABSTRACT

The invention presents an innovative design for floating shelf hardware offering simple adjustable positioning of shelf extension arms and shelfs, while maintaining appropriate shelf support. It comprises a wall plate, slider, and shelf extension arms, providing a high degree of customization for users.

13 Claims, 12 Drawing Sheets

(56) References Cited

U.S. PATENT DOCUMENTS

| | | | | |
|---|---|---|---|---|
| 12,268,303 | B1 * | 4/2025 | Merrill | A47B 96/061 |
| 2007/0125738 | A1 * | 6/2007 | Sevack | A47B 96/066<br>211/187 |
| 2008/0047911 | A1 * | 2/2008 | Kao | A47F 5/0838<br>211/70.6 |
| 2009/0224119 | A1 * | 9/2009 | Heffernan | A47B 96/066<br>248/220.21 |
| 2011/0147551 | A1 * | 6/2011 | Richard | A47B 96/067<br>29/428 |
| 2011/0226715 | A1 * | 9/2011 | Schwartzkopf | A47F 5/0838<br>211/183 |
| 2019/0380489 | A1 * | 12/2019 | Gordon | A47B 81/00 |
| 2023/0180933 | A1 * | 6/2023 | Horezga | A47B 96/061<br>248/250 |
| 2024/0090666 | A1 * | 3/2024 | Anderson | A47B 96/066 |

* cited by examiner

ADJUSTABLE FLOATING SHELF

CROSS-REFERENCE TO RELATED APPLICATIONS

This application claims the benefit of U.S. Provisional Application No. 63/518,759, filed Aug. 10, 2023, which is hereby incorporated by reference in its entirety as if fully set forth herein.

FIELD OF THE INVENTION

The present invention relates generally to adjustable floating shelf systems that are suitable for a variety of applications. More specifically, the invention relates to adjustable floating shelf hardware with enhanced flexibility and customization.

BACKGROUND OF THE INVENTION

Traditional floating shelf systems are often restrictive in terms of adjustability, limiting the user's flexibility in arranging and positioning the shelves. The existing designs also typically require specific placement points for the shelf extension arms, restricting the customization of the system.

In view of the above, the present invention addresses these challenges by offering a design that allows variable placement of the shelf extension arms along the wall plate, thereby providing a more adaptable floating shelf system.

SUMMARY OF THE INVENTION

The present invention provides an advanced design for floating shelf hardware, focusing on allowing simple adjustable positioning of shelf extension arms for enhanced flexibility and customization, while able to appropriately support shelves. The hardware includes a wall plate, a shelf slider, and shelf extension arms. The wall plate has a series of screw holes at intervals to permit variable placement on a wall, and are vertically spaced to accommodate different cross section shelves. Two angular surfaces extend from the wall plate's front face, creating a retaining lip on the top and bottom.

The shelf slider, designed to correspond with the wall plate geometry, can slide along the wall plate's full length. The shelf extension arms can be threaded into the slider's threaded opening. When the extension arms are fully threaded, the back surface of the shelf extension arms contact the face of the wall plate, thereby preventing further movement of the slider.

One of the improvements over existing floating shelf systems is that users can adjust the placement and spacing of the extension arms along the mounting plate according to their needs. Moreover, additional arms can be added for increased support if required, thereby offering superior adaptability.

Aspects and advantages will become apparent to those of ordinary skill in the art by reading the following detailed description, with reference where appropriate to the accompanying drawings. Further, it should be understood that the foregoing summary is merely illustrative and is not intended to limit in any manner the scope or range of equivalents to which the appended claims are lawfully entitled.

BRIEF DESCRIPTION OF THE DRAWINGS

The invention is described below in connection with the following illustrative figures, wherein.

It should be noted that the figures herein are not to scale, and the floating shelf system illustrated is not limited to the scale shown in the figures.

DETAILED DESCRIPTION

While the present invention is capable of being embodied in various forms, for simplicity and illustrative purposes, the principles of the invention are described by referring to several embodiments thereof. It is understood, however, that the present disclosure is to be considered as an exemplification of the claimed subject matter, and is not intended to limit the appended claims to the specific embodiments illustrated. It will be apparent to one of ordinary skill in the art that the invention may be practiced without limitation to these specific details. Additionally, as persons of ordinary skill in the art will appreciate, in certain instances, well-known methods and structures have not been described in detail so as not to unnecessarily obscure the invention.

The floating shelf hardware system presented here includes four components: a wall plate, a shelf slider, shelf extension arms, and wall screws. The wall plate is anchored to the wall where the shelf system will be installed. The shelf slider is movably connected to the wall plate and able to move along the length of the wall plate. The shelf extension arms are connected to the slider through threaded connections and are capable of supporting adjustable floating shelves.

Figure 1:
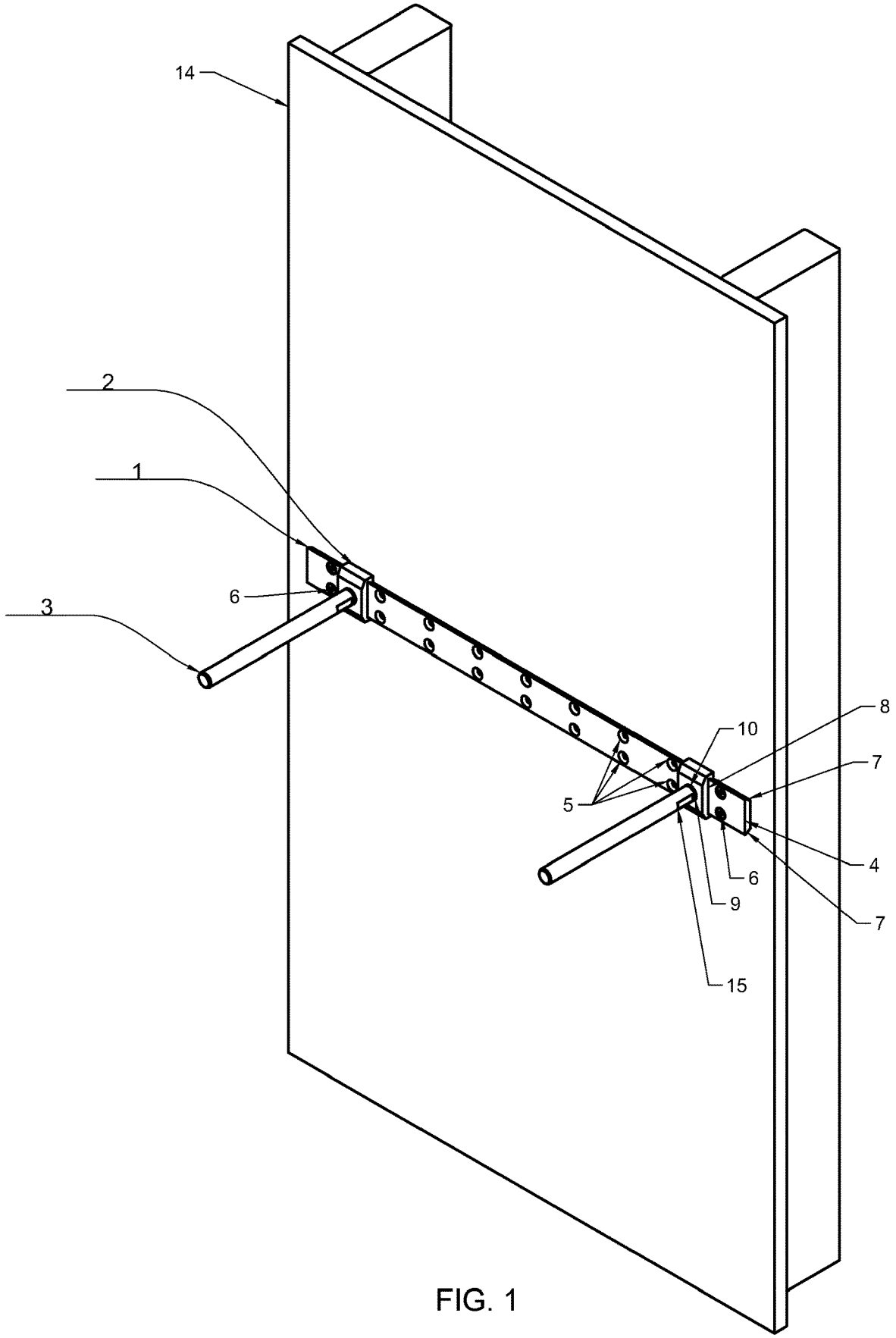
FIG. 1 shows the floating shelf hardware when it is fully assembled and mounted on a wall, illustrating the components—the wall plate (1), shelf slider (2), shelf extension arms (3), front face (4), screw holes (5), stud attachment point (6), angular surface (7), geometry to the wall plate (8), threaded opening (9), thread (10), wall (14), and locking tool flat contact points (15), according to an embodiment of the invention.

FIG. 1 shows an embodiment of the floating shelf hardware when it is fully assembled and mounted on a wall (14). A wall plate (1) is affixed to the wall using wall screws (13) (shown in FIG. 2). A shelf extension arm (3) is connected to a shelf slider (2) through a threaded connection, enabling the slider to move horizontally along the full length of the front face (4) of the wall plate.

The wall plate incorporates a series of screw holes (5) vertically aligned to each other and placed at various horizontal intervals along the wall plate. The vertically aligned holes having at least two holes provide appropriate vertical support for the adjustable shelf. The at least one stud attachment point (6) allows for variable placement on a wall. This movement is facilitated by the matching geometry (8) of the shelf slider (2) which includes a flat interior surface that runs parallel to the front face of the wall plate, and two angular surfaces which run parallel and with two angular surfaces (7) of the wall plate, matching the geometry of the wall plate (1), and touching to guide the motion. The slider has a threaded opening (9) which runs the full thickness of the slider which allows attachment of shelf extension arms (3). When this threaded connection is fully tightened into the slider using the locking tool flat contact points (15) the back surface (11) of the shelf arms makes contact with the front face (4) of the wall plate, pulling the angled surfaces of the slider geometry (8) against the angled surfaces (7) of the wall plate and preventing further movement of the slider.

The shelf slider (2) has a geometry (8) that is designed to match the wall plate geometry, having a flat interior surface that sits parallel with the front face of the wall plate and two angular surfaces extending from the flat interior surface towards the center and running parallel to the angular surfaces of the wall plate, allowing it to slide onto on end and move along the wall plate's entire length. The fit between the slider and the wall plate is sufficiently loose to allow the sliding movement, but tight enough to prevent the slider from binding on the wall plate as it slides.

The width of the shelf slider (2) is at least 80% of the height of the wall plate to provide sufficient contact surface along the angular surfaces of the wall plate and the slider to prevent binding and provide sufficient retention of the slider on the wall plate. It features a threaded opening through its center that extends across its full thickness.

Figure 3A:
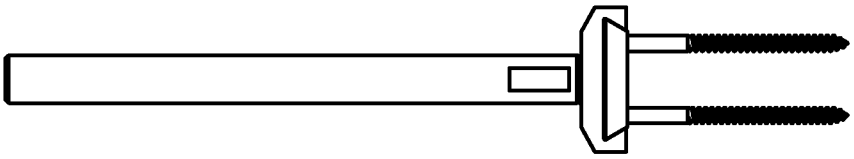
FIGS. 3A and 3B show a side and cross-sectional view of a wall plate, shelf extension arm, and shelf slider, where the shelf extension arm is threaded to the slider and the wall plate, according to an embodiment of the invention.
Figure 3B:
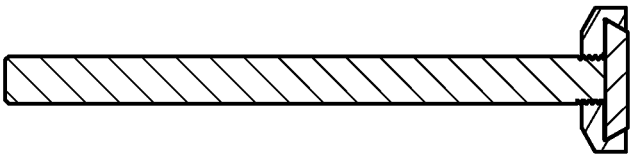

FIGS. 3A and 3B show a side and cross-sectional view of a wall plate, shelf extension arm, and shelf slider, where the shelf extension arm is threaded to the slider and the wall plate, according to an embodiment of the invention.

Figure 4A:
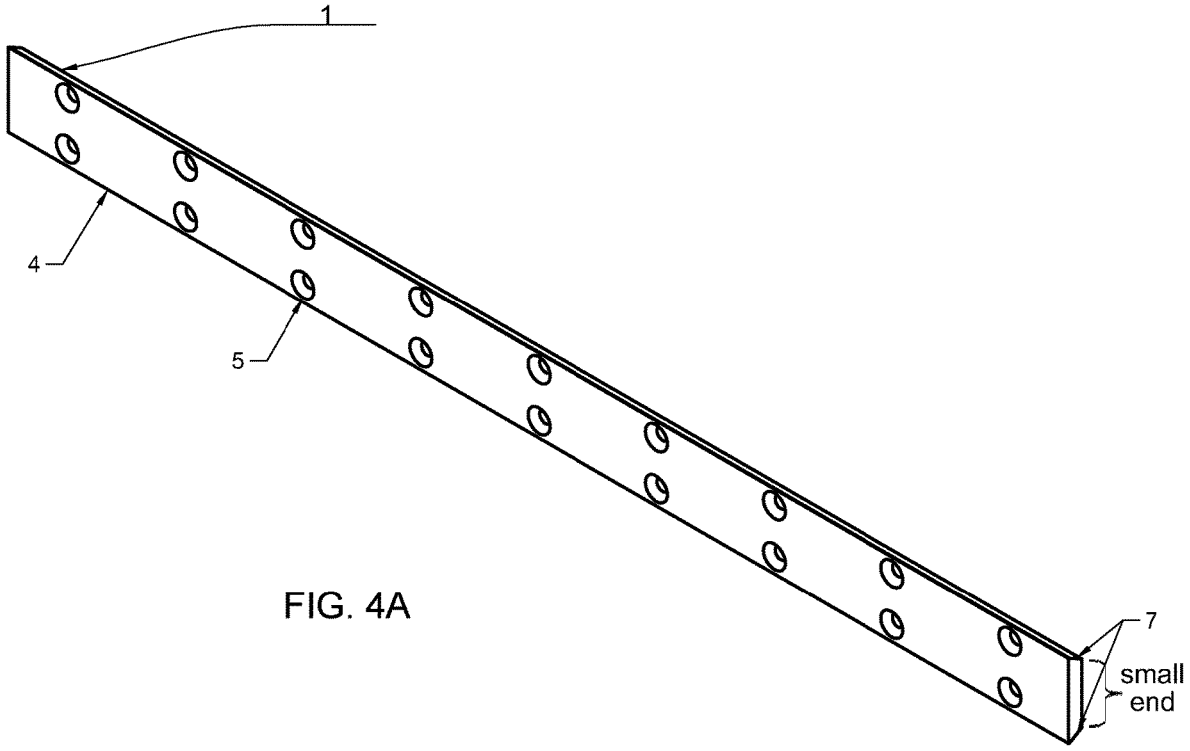
FIGS. 4A, 4B and 4C illustrate the attachment method of the shelf slider (2) to the wall plate (1), and the shelf extension arm (3) to the shelf slider (2), illustrating the components—front face (4), screw holes (5), angular surface (7), geometry to the wall plate (8), threaded opening (9), thread (10), shelf extension arm back surface (11), and locking tool flat contact point (15), according to an embodiment of the invention.
Figure 4C:
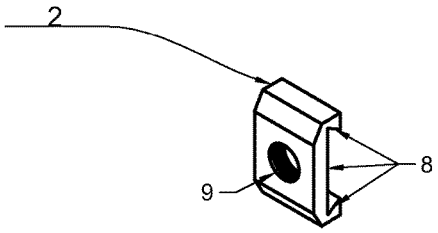
Figure 4B:
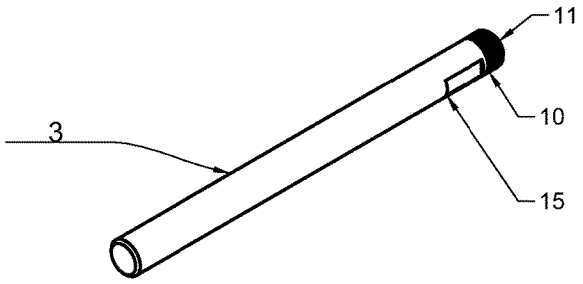

FIGS. 4A, 4B and 4C illustrates an embodiment of the attachment method of the slider to the wall plate (1). A shelf extension arm (3) is affixed to a shelf slider (2) through a threaded connection (10). Following this connection, the interaction of two angular surfaces forms a lip, providing a track that enables the slider to move horizontally.

Figure 2:
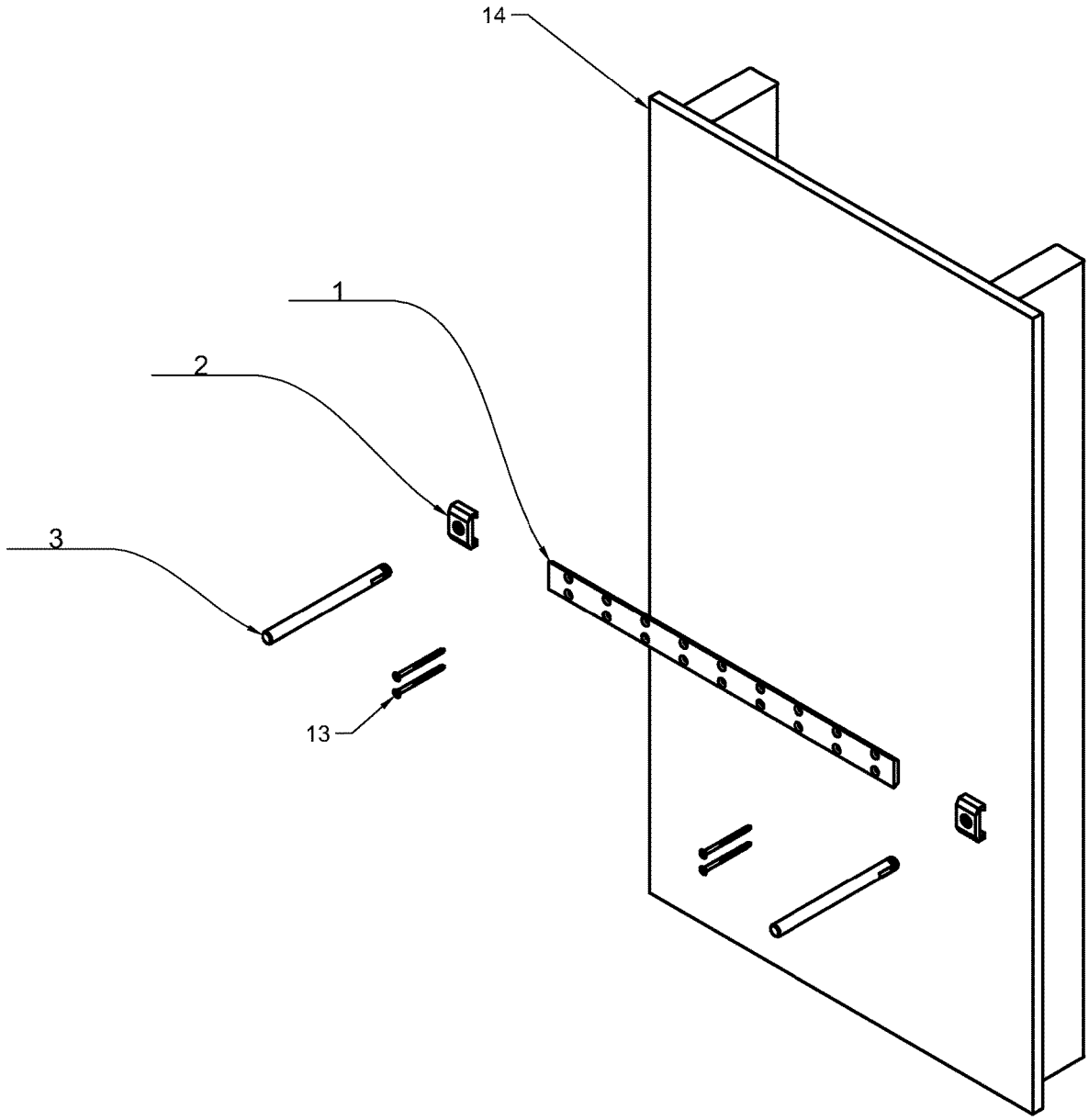
FIG. 2 shows an exploded view of the floating shelf hardware, illustrating the components—the wall plate (1), shelf slider (2), shelf extension arms (3), screws (13), and wall (14), according to an embodiment of the invention.

The series of screw holes (5) are spaced at intervals, allowing variable placement on a wall. The screw holes may be a circle as shown in FIGS. 1, 2, and 4A. The screw holes have an angled entry point allowing the screw heads to sit recessed from the front face of the wall plate. Two angular surfaces extend from the front face of the wall plate towards the wall, forming a trapezoid geometry and a retaining lip on both top and bottom. The angle of the surfaces are sufficiently shallow so that when the angled surfaces of the slider are pulled against the angled surfaces of the wall plate, they align and allow the slider to self-center on the wall plate keeping the shelf extension arms aligned horizontally with each other. The wall plate may be securely attached to a wall, or wall stud, using wall anchoring screws.

FIG. 2 shows an exploded view of the floating shelf hardware, illustrating the components—the wall plate (1), shelf slider (2), shelf extension arms (3), screws (13), and wall (14), according to an embodiment of the invention. The wall screws (13) mounts the wall plate (1) onto the wall (14). A shelf extension arm (3) attaches to shelf sliders (2), which slide between the lips of the wall plate (1).

The shelf extension arms (3) are threaded into the shelf slider's opening. The back surface (11) of each shelf extension arm is parallel to the front face of the wall plate and contacts the face of the wall plate. When fully threaded, the back surface of the shelf extension arms makes contact with the front face of the wall plate, the angled surfaces of the slider are pulled against the wall plate's angled surfaces, allowing the slider to self-center and preventing further slider movement. The shelf extension arms have flat tool contact points (15) near the threaded end to allow use of a tool, such as a wrench, to tighten the shelf extension arms into the slider when they are in their desired location.

This design allows variable placement of the entire bracket system along the wall. It also provides the flexibility to adjust the placement and spacing of the extension arms along the mounting plate and the number of arms as necessary to support the weight of the shelf. The mounting plate may be lengthened and the arm place adjusted to accommodate a longer wall plate length, and shelf arms may be added. The mounting plate may also be shortened and the arm placement adjusted to accommodate the reduced wall plate length.

Figure 5:
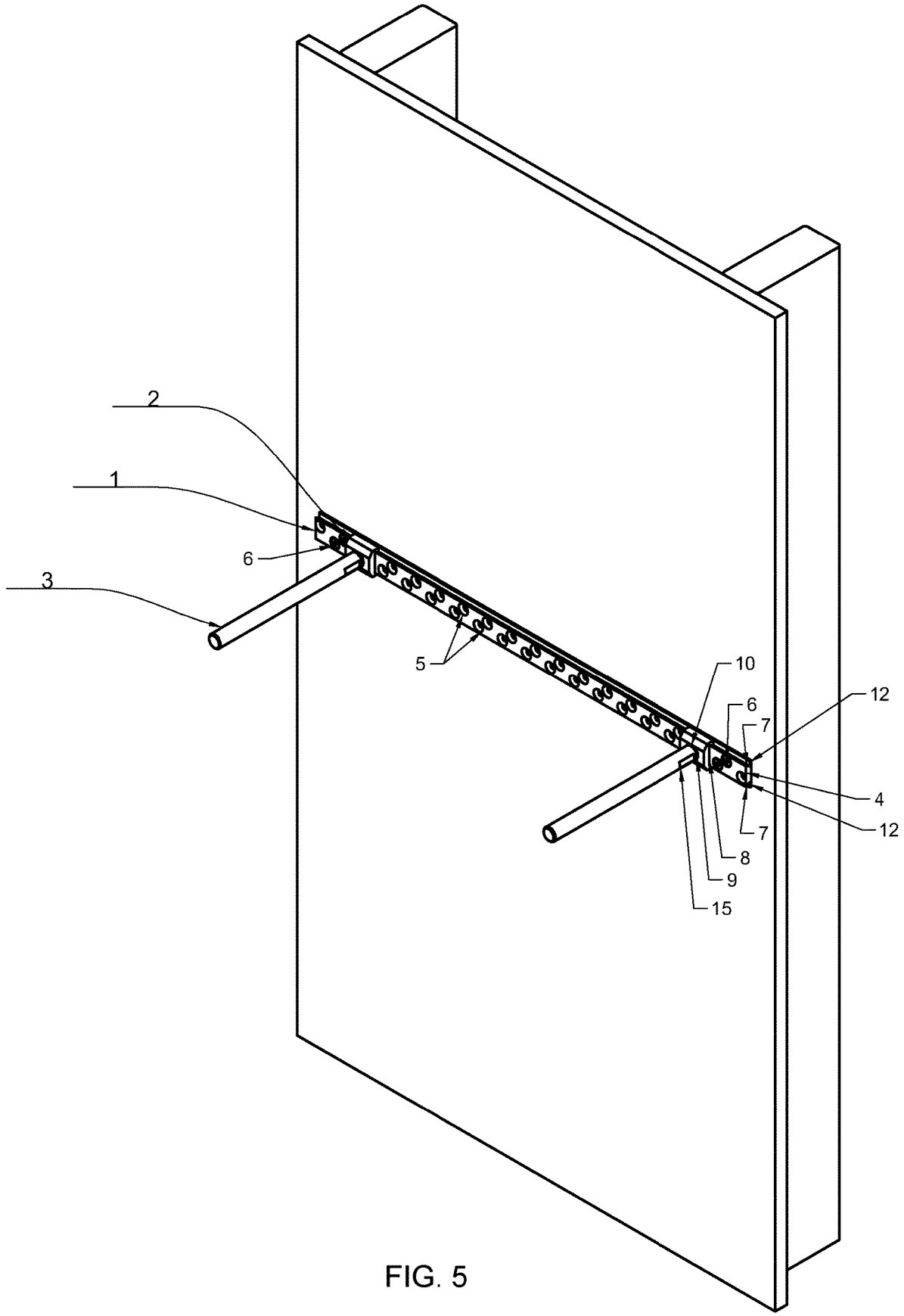
FIG. 5 shows the floating shelf hardware when it is fully assembled and mounted on a wall, illustrating the components—the wall plate (1), shelf slider (2), shelf extension arms (3), front face (4), screw holes (5), stud attachment point (6), angular surface (7), geometry to the wall plate (8), threaded opening (9), thread (10), protrusion extending from the small end (12), wall (14), and locking tool flat contact points (15), according to an embodiment of the invention.

FIG. 5 shows an embodiment of the floating shelf hardware when it is fully assembled and mounted on a wall (14).

Figure 6:
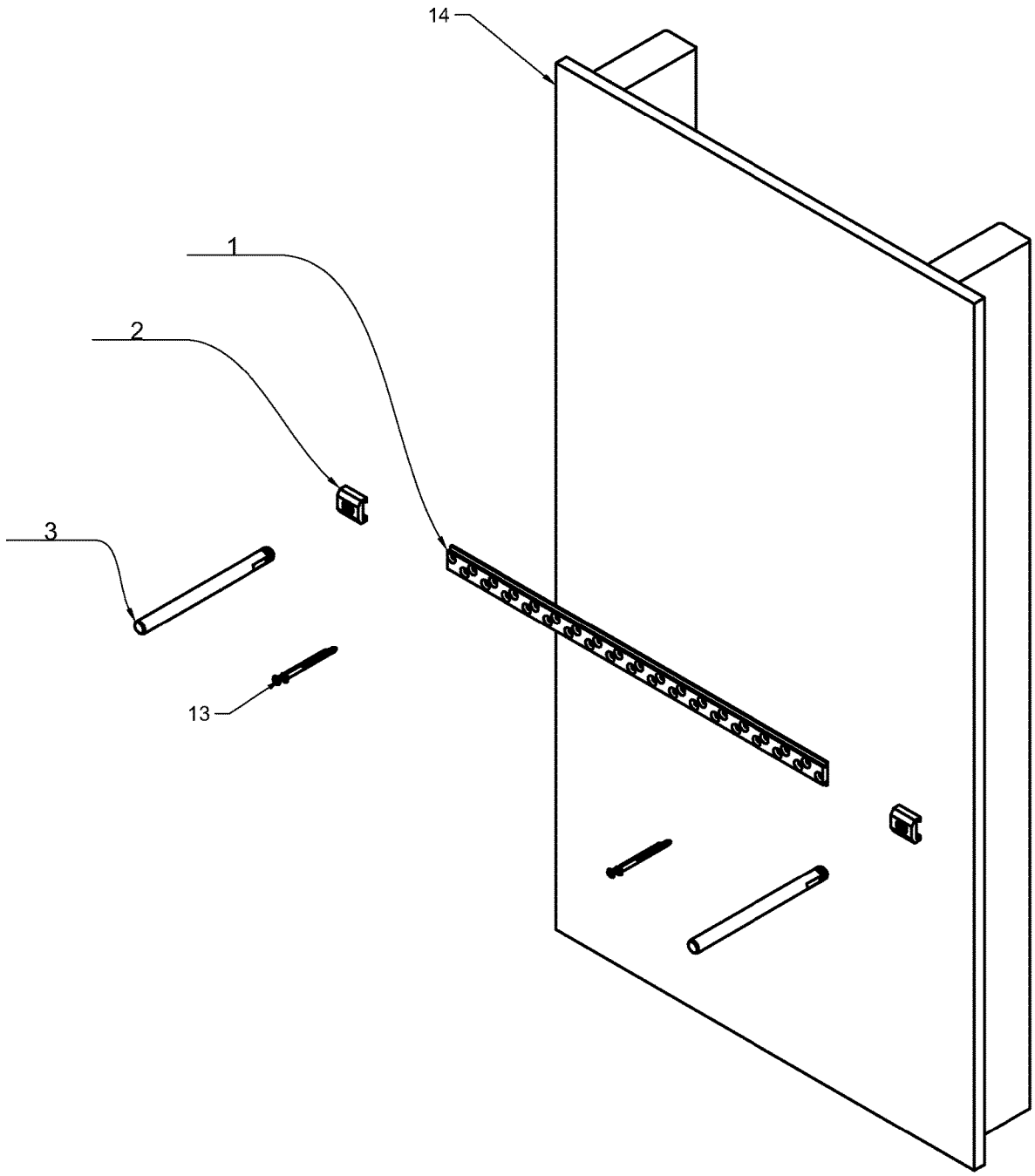
FIG. 6 shows an exploded view of the floating shelf hardware, illustrating the components—the wall plate (1), shelf slider (2), shelf extension arms (3), screws (13), and wall (14), according to an embodiment of the invention.

A wall plate (1) is affixed to the wall using wall screws (13) (shown in FIG. 6). Shelf extension arms (3) are connected to a shelf slider (2) through a threaded connection, enabling the slider to move horizontally along the full length of the front face (4) of the wall plate.

The wall plate incorporates a series of screw holes (5) vertically aligned to each other in an overlapping manner and placed at various horizontal intervals along the wall plate. The vertically aligned holes include at least two holes to provide appropriate vertical support for the adjustable shelf, but that vertically overlap so that they may be spaced closer together vertically, allowing the front face of the wall plate to have a reduced height and width. This reduced width accommodates smaller cross section shelves, while still maintaining appropriate support for their weight. For example, the reduced width is able to accommodate a cross section shelf that of 1.5 inches.

The at least one stud attachment point (6) allows for variable placement on a wall. This movement is facilitated by the matching geometry (8) of the shelf slider (2) which includes a flat interior surface that runs parallel to the front face of the wall plate, and two angular surfaces which run parallel and with two angular surfaces (7) of the wall plate, matching the geometry of the wall plate (1), and touching to guide the motion. The slider has a threaded opening (9) which runs the full thickness of the slider which allows attachment of shelf extension arms (3). When this threaded connection is fully tightened into the slider using the locking tool flat contact points (15) the back surface (11) of the shelf arms makes contact with the front face (4) of the wall plate, pulling the angled surfaces of the slider geometry (8) against the angled surfaces (7) of the wall plate and preventing further movement of the slider.

The front face of the wall plate has a reduced height and width that tightly accommodate the screw holes (5) while still having two angular surfaces (7) forming a retaining lip. The shelf slider (2) has a geometry (8) that is designed to match the wall plate geometry, having a flat interior surface that sits parallel with the front face of the wall plate and two angular surfaces extending from the flat interior surface towards the center and running parallel to the angular surfaces of the wall plate, allowing it to slide onto on end and move along the wall plate's entire length. The fit between the slider and the wall plate is sufficiently loose to allow the sliding movement, but tight enough to prevent the slider from binding on the wall plate as it slides.

The reduced width of the shelf slider (2) is at least 80% of the reduced height of the wall plate to provide sufficient contact surface along the angular surfaces of the wall plate and the slider to prevent binding and provide sufficient retention of the slider on the wall plate. It features a threaded opening through its center that extends across its full thickness.

Figure 7A:
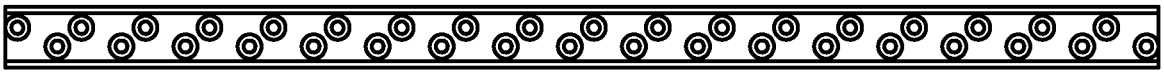
FIG. 7A shows a wall plate and FIGS. 7B, and 7C show a side and cross-sectional view of the wall plate, shelf extension arm, and shelf slider, where the shelf extension arm is threaded to the slider and the wall plate, according to an embodiment of the invention.
Figure 7B:
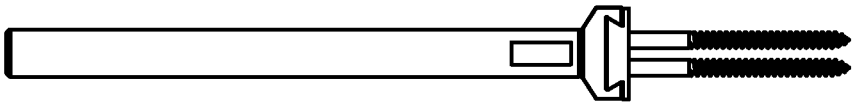
Figure 7C:
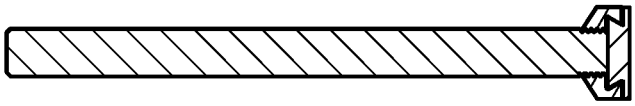

FIG. 7A shows the wall plate and FIGS. 7B, and 7C show a side and cross-sectional view of a wall plate, shelf extension arm, and shelf slider, where the shelf extension arm is threaded to the slider and the wall plate.

Figure 8A:
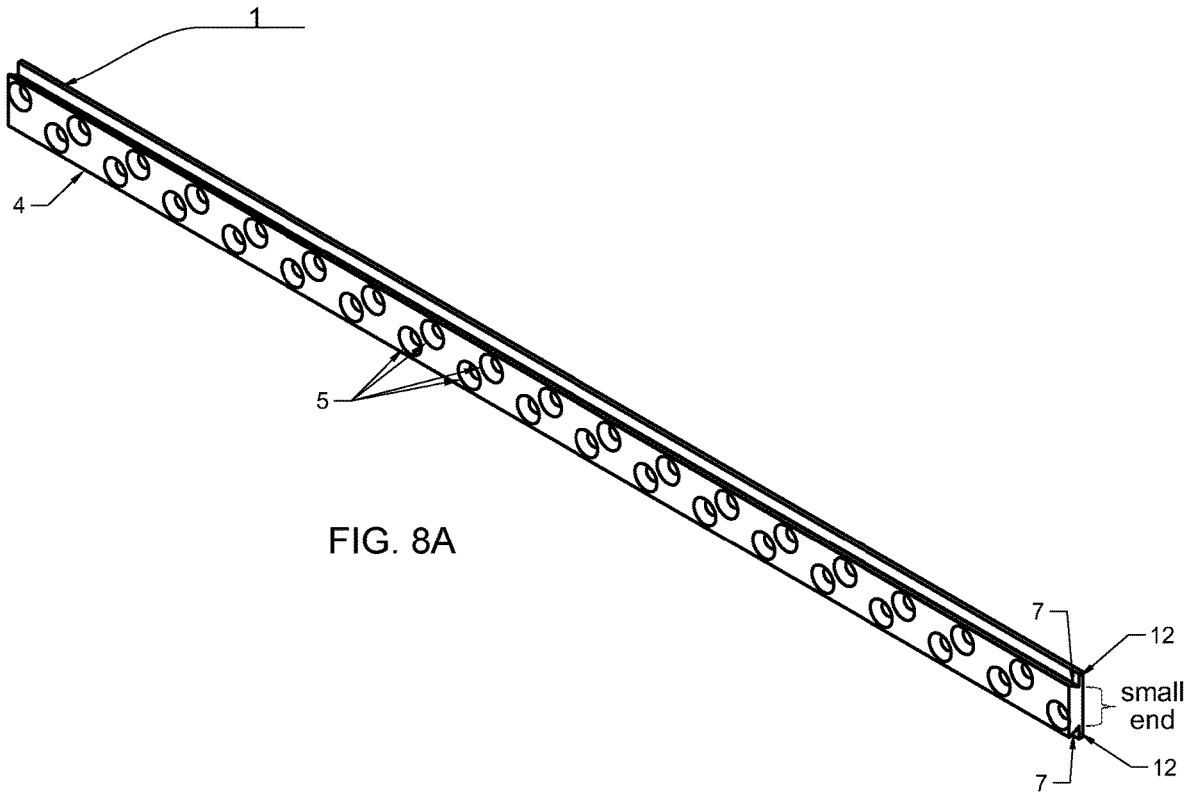
FIGS. 8A, 8B and 8C illustrate the attachment method of the shelf slider (2) to the wall plate (1), and the shelf extension arm (3) to the shelf slider (2), illustrating the components—front face (4), screw holes (5), angular surface (7), geometry to the wall plate (8), thread (10), shelf extension arm back surface (11), protrusion extending from the small end (12), and locking tool flat contact point (15), according to an embodiment of the invention.
Figure 8C:
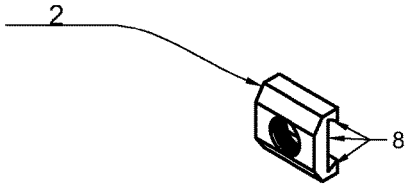
Figure 8B:
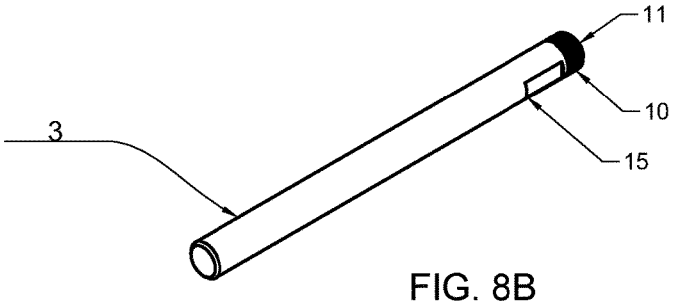

FIGS. 8A, 8B and 8C illustrate the attachment method of the shelf slider (2) to the wall plate (1), and the shelf extension arm (3) to the shelf slider (2), illustrating the components-front face (4), screw holes (5), angular surface (7), geometry to the wall plate (8), thread (10), shelf extension arm back surface (11), protrusion extending from the small end (12), and locking tool flat contact point (15). The shelf extension arm (3) is affixed to a shelf slider (2) through a threaded connection (10). Following this connection, the interaction of two angular surfaces forms a lip, providing a track that enables the slider to move horizontally.

The series of screw holes (5) are spaced at intervals, allowing variable placement on a wall. The screw holes may be a circle as shown in FIGS. 5, 6, 7A, and 8A. The screw holes have an angled entry point allowing the screw heads to sit recessed from the front face of the wall plate. Two angular surfaces extend from the front face of the wall plate towards the wall, forming a trapezoid geometry and a retaining lip on both top and bottom. The angle of the surfaces are sufficiently shallow so that when the angled surfaces of the slider are pulled against the angled surfaces of the wall plate, they align and allow the slider to self-center on the wall plate keeping the shelf extension arms aligned horizontally with each other. The wall plate may be securely attached to a wall, or wall stud, using wall anchoring screws.

The wall plate includes a protrusion (12) from the small end of the angled surfaces that runs parallel to the front face, providing increased contact surface area between the wall plate and the wall, while the wall plate maintains its decreased height. The flanged back gives additional support. This provides the ability for the wall plate to support smaller cross section shelves, while also maintaining appropriate support for the weight of the shelf and preventing wobbling.

FIG. 6 shows an exploded view of the floating shelf hardware, illustrating the components—the wall plate (1), shelf slider (2), shelf extension arms (3), screws (13), and wall (14). The wall screws (13) mounts the wall plate (1) onto the wall (14). A shelf extension arm (3) attaches to shelf sliders (2), which slide between the lips of the wall plate (1).

The shelf extension arms (3) are threaded into the shelf slider's opening. The back surface (11) of each shelf extension arm is parallel to the front face of the wall plate and contacts the face of the wall plate. When fully threaded, the back surface of the shelf extension arms makes contact with the front face of the wall plate, the angled surfaces of the slider are pulled against the wall plate's angled surfaces, allowing the slider to self-center and preventing further slider movement. The shelf extension arms have flat tool contact points (15) near the threaded end to allow use of a tool, such as a wrench, to tighten the shelf extension arms into the slider when they are in their desired location.

Figure 9:
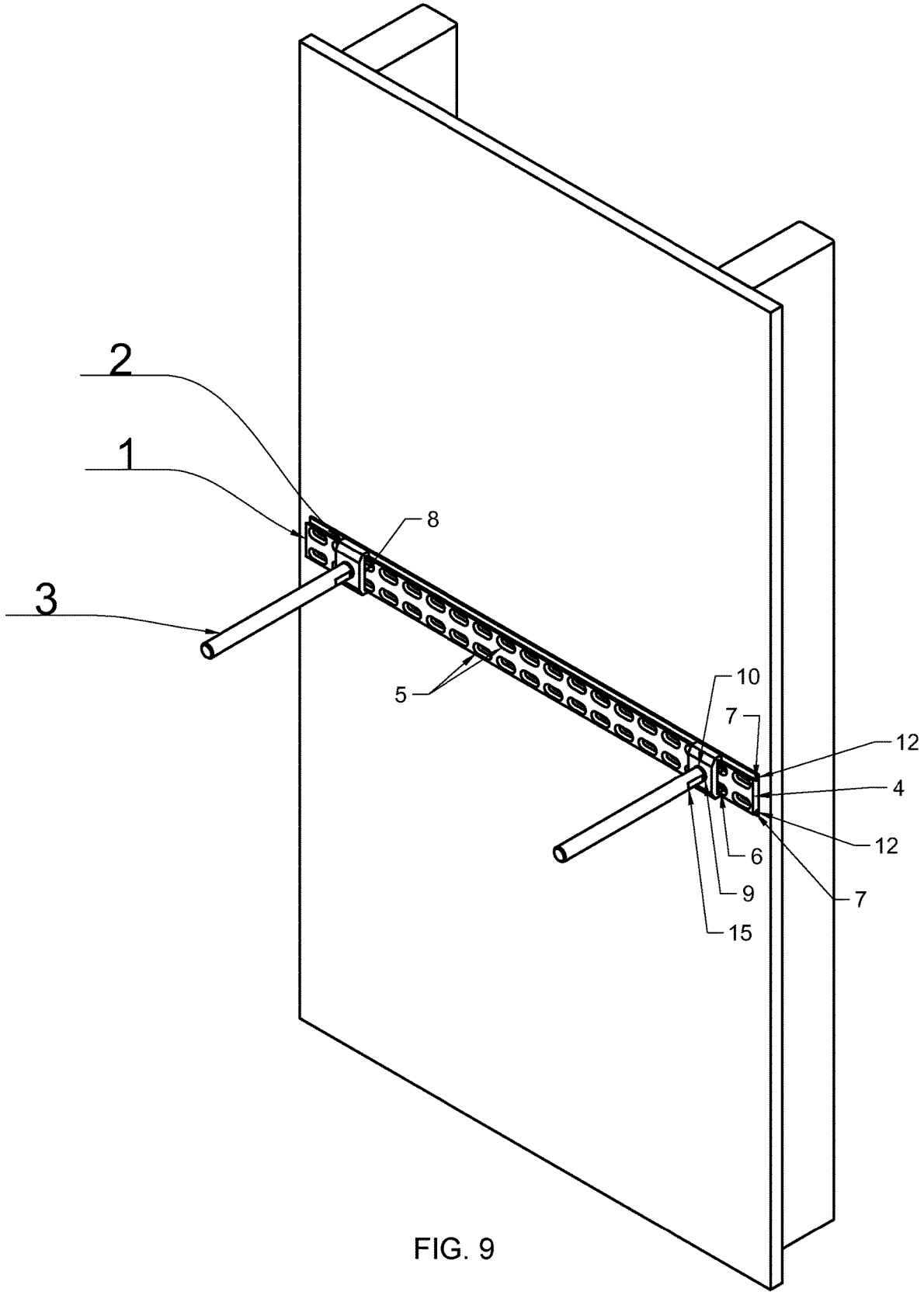
FIG. 9 shows the floating shelf hardware when it is fully assembled and mounted on a wall, illustrating the components—the wall plate (1), shelf slider (2), shelf extension arms (3), front face (4), screw holes (5), stud attachment point (6), angular surface (7), geometry to the wall plate (8), threaded opening (9), thread (10), protrusion extending from the small end (12), and locking tool flat contact points (15), according to an embodiment of the invention.

FIG. 9 shows an embodiment of the floating shelf hardware when it is fully assembled and mounted on a wall (14). A wall plate (1) is affixed to the wall using wall screws (13) (shown in FIG. 10). Shelf extension arms (3) are connected to a shelf slider (2) through a threaded connection, enabling the slider to move horizontally along the full length of the front face (4) of the wall plate.

The wall plate incorporates a series of screw holes (5) vertically aligned to each other and placed at various horizontal intervals along the wall plate. The vertically aligned holes having at least two holes provide appropriate vertical support for the adjustable shelf. The at least one stud attachment point (6) allows for variable placement on a wall. This movement is facilitated by the matching geometry (8) of the shelf slider (2) which includes a flat interior surface that runs parallel to the front face of the wall plate, and two angular surfaces which run parallel and with two angular surfaces (7) of the wall plate, matching the geometry of the wall plate (1), and touching to guide the motion. The slider has a threaded opening (9) which runs the full thickness of the slider which allows attachment of shelf extension arms (3). When this threaded connection is fully tightened into the slider using the locking tool flat contact points (15) the back surface (11) of the shelf arms makes contact with the front face (4) of the wall plate, pulling the angled surfaces of the slider geometry (8) against the angled surfaces (7) of the wall plate and preventing further movement of the slider.

The front face of the wall plate has a reduced height and width that tightly accommodate the screw holes (5) while still having two angular surfaces (7) forming a retaining lip. The shelf slider (2) has a geometry (8) that is designed to match the wall plate geometry, having a flat interior surface that sits parallel with the front face of the wall plate and two angular surfaces extending from the flat interior surface towards the center and running parallel to the angular surfaces of the wall plate, allowing it to slide onto on end and move along the wall plate's entire length. The fit between the slider and the wall plate is sufficiently loose to allow the sliding movement, but tight enough to prevent the slider from binding on the wall plate as it slides.

The reduced width of the shelf slider (2) is at least 80% of the reduced height of the wall plate to provide sufficient contact surface along the angular surfaces of the wall plate and the slider to prevent binding and provide sufficient retention of the slider on the wall plate. It features a threaded opening through its center that extends across its full thickness.

Figure 11A:
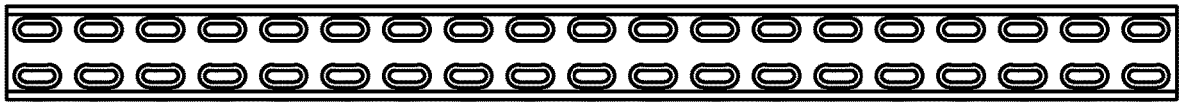
FIG. 11A shows a wall plate and FIGS. 11B, and 11C show a side and cross-sectional view of the wall plate, shelf extension arm, and shelf slider, where the shelf extension arm is threaded to the slider, according to an embodiment of the invention.
Figure 11B:
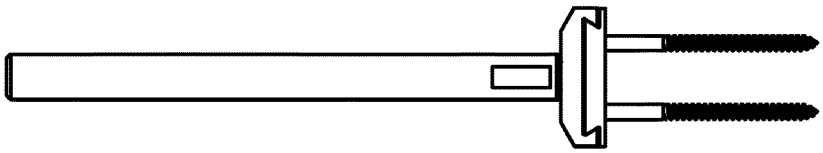
Figure 11C:
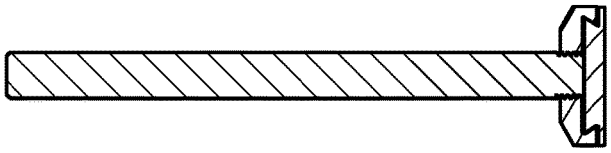

FIG. 11A shows a wall plate and FIGS. 11B, and 11C show a side and cross-sectional view of the wall plate, shelf extension arm, and shelf slider, where the shelf extension arm is threaded to the slider.

Figure 12A:
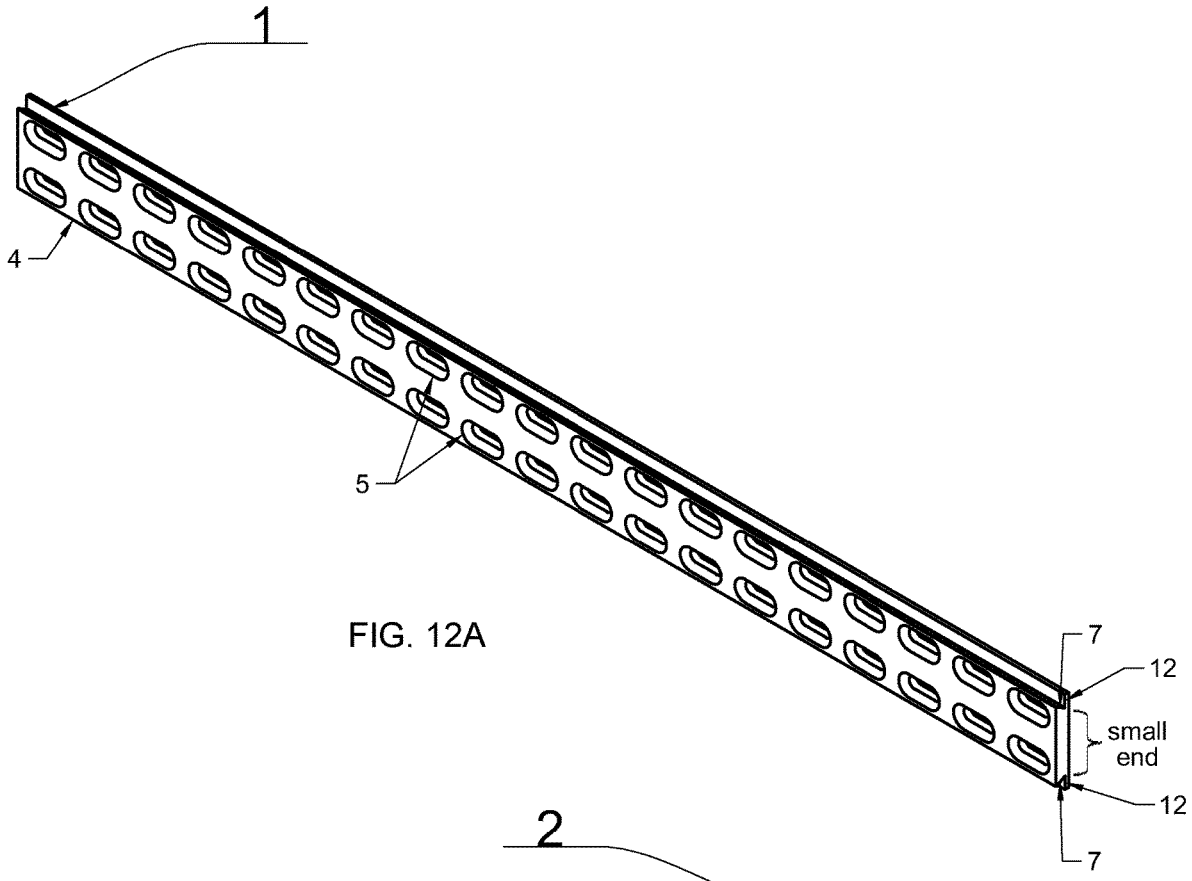
FIGS. 12A, 12B and 12C illustrate the attachment method of the shelf slider (2) to the wall plate (1), and the shelf extension arm (3) to the shelf slider (2), illustrating the components—front face (4), screw holes (5), angular surface (7), geometry to the wall plate (8), thread (10), shelf extension arm back surface (11), protrusion extending from the small end (12), and locking tool flat contact point (15), according to an embodiment of the invention.
Figure 12C:
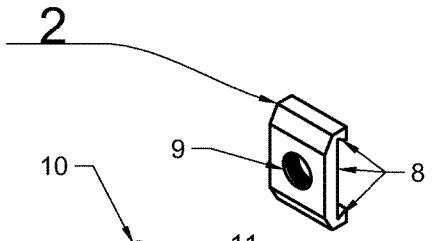
Figure 12B:
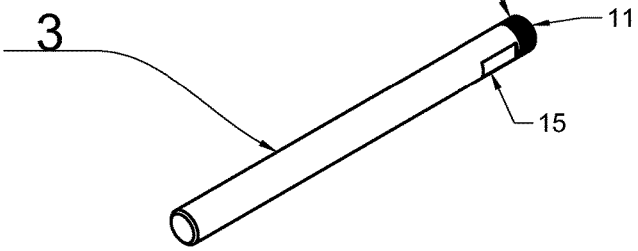

FIGS. 12A, 12B and 12C illustrate the attachment method of the shelf slider (2) to the wall plate (1), and the shelf extension arm (3) to the shelf slider (2), illustrating the components—front face (4), screw holes (5), angular surface (7), geometry to the wall plate (8), thread (10), shelf extension arm back surface (11), protrusion extending from the small end (12), and locking tool flat contact point (15). The shelf extension arm (3) is affixed to a shelf slider (2) through a threaded connection (10). Following this connection, the interaction of two angular surfaces forms a lip, providing a track that enables the slider to move horizontally.

The series of screw holes (5) are spaced at intervals, allowing variable placement on a wall. The screw holes may be an oval or ellipse shape, as shown in FIGS. 9, 10, 11A, and 12A, that allows for a larger degree of variation in placement on the wall. The screw holes have an angled entry point allowing the screw heads to sit recessed from the front face of the wall plate. Two angular surfaces extend from the front face of the wall plate towards the wall, forming a trapezoid geometry and a retaining lip on both top and bottom. The angle of the surfaces are sufficiently shallow so that when the angled surfaces of the slider are pulled against the angled surfaces of the wall plate, they align and allow the slider to self-center on the wall plate keeping the shelf extension arms aligned horizontally with each other. The wall plate may be securely attached to a wall, or wall stud, using wall anchoring screws.

The wall plate includes a protrusion (12) from the small end of the angled surfaces that runs parallel to the front face, providing increased contact surface area between the wall plate and the wall, while the wall plate maintains its decreased height. The flanged back gives additional support. This provides the ability for the wall plate to support smaller cross section shelves, while also maintaining appropriate support for the weight of the shelf and preventing wobbling.

Figure 10:
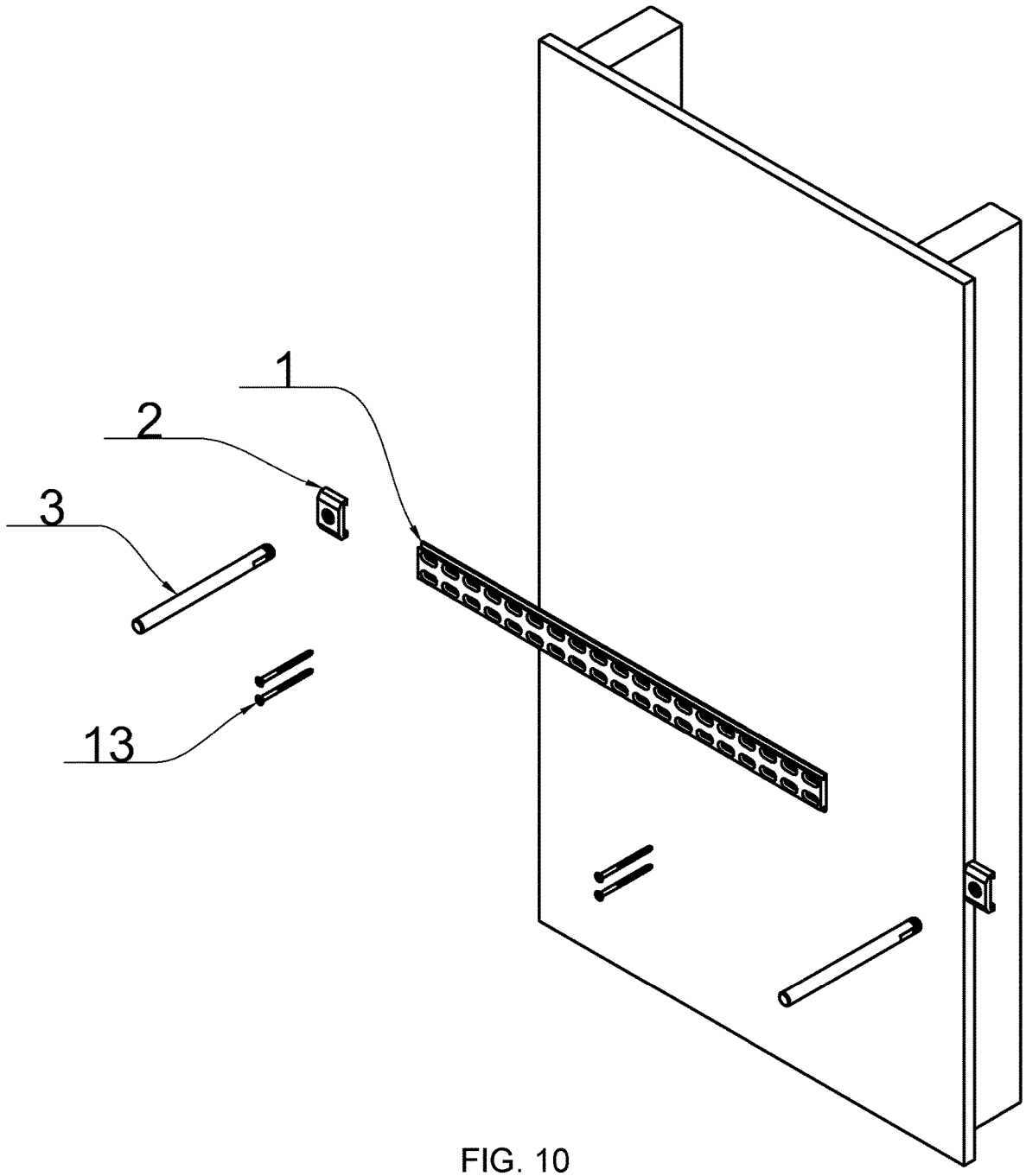
FIG. 10 shows an exploded view of the floating shelf hardware, illustrating the components—the wall plate (1), shelf slider (2), shelf extension arms (3), and screws (13), according to an embodiment of the invention.

FIG. 10 shows an exploded view of the floating shelf hardware, illustrating the components—the wall plate (1), shelf slider (2), shelf extension arms (3), screws (13), and wall (14). The wall screws (13) mounts the wall plate (1) onto the wall (14). A shelf extension arm (3) attaches to shelf sliders (2), which slide between the lips of the wall plate (1).

The shelf extension arms (3) are threaded into the shelf slider's opening. The back surface (11) of each shelf extension arm is parallel to the front face of the wall plate and contacts the face of the wall plate. When fully threaded, the back surface of the shelf extension arms makes contact with the front face of the wall plate, the angled surfaces of the slider are pulled against the wall plate's angled surfaces, allowing the slider to self-center and preventing further slider movement. The shelf extension arms have flat tool contact points (15) near the threaded end to allow use of a tool, such as a wrench, to tighten the shelf extension arms into the slider when they are in their desired location.

While the invention has been described in terms of several preferred embodiments, it should be understood that there are many alterations, permutations, and equivalents that fall within the scope of this invention. It should also be noted that there are alternative ways of implementing the apparatus of the present invention. It is therefore intended that the appended claim includes all such alterations, permutations, and equivalents as fall within the true spirit and scope of the present invention.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar references in the context of this disclosure (especially in the context of the following claims) are to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., such as, preferred, preferably) provided herein, is intended merely to further illustrate the content of the disclosure and does not pose a limitation on the scope of the claims. No language in the specification should be construed as indicating any non-claimed element as essential to the practice of the present disclosure.

Multiple embodiments are described herein, including the best mode known to the inventors for practicing the claimed invention. Of these, variations of the disclosed embodiments will become apparent to those of ordinary skill in the art upon reading the foregoing disclosure. The inventors expect skilled artisans to employ such variations as appropriate (e.g., altering or combining features or embodiments), and the inventors intend for the invention to be practiced otherwise than as specifically described herein.

Accordingly, this invention includes all modifications and equivalents of the subject matter recited in the claims appended hereto as permitted by applicable law. Moreover, any combination of the above described elements in all possible variations thereof is encompassed by the invention unless otherwise indicated herein or otherwise clearly contradicted by context.

The use of individual numerical values are stated as approximations as though the values were preceded by the word "about" or "approximately." Similarly, the numerical values in the various ranges specified in this application, unless expressly indicated otherwise, are stated as approximations as though the minimum and maximum values within the stated ranges were both preceded by the word "about" or "approximately." In this manner, variations above and below the stated ranges can be used to achieve substantially the same results as values within the ranges. As used herein, the terms "about" and "approximately" when referring to a numerical value shall have their plain and ordinary meanings to a person of ordinary skill in the art to which the disclosed subject matter is most closely related or the art relevant to the range or element at issue. The amount of broadening from the strict numerical boundary depends upon many factors. For example, some of the factors which may be considered include the criticality of the element and/or the effect a given amount of variation will have on the performance of the claimed subject matter, as well as other considerations known to those of skill in the art. As used herein, the use of differing amounts of significant digits for different numerical values is not meant to limit how the use of the words "about" or "approximately" will serve to broaden a particular numerical value or range. Thus, as a general matter, "about" or "approximately" broaden the numerical value. Also, the disclosure of ranges is intended as a continuous range including every value between the minimum and maximum values plus the broadening of the range afforded by the use of the term "about" or "approximately." Thus, recitation of ranges of values herein are merely intended to serve as a shorthand method of referring individually to each separate value falling within the range, unless otherwise indicated herein, and each separate value is incorporated into the specification as if it were individually recited herein.

What is claimed is:

1. A floating shelf hardware comprising:
- a wall plate comprising
  - a full length;
  - a height comprising a center,
    - wherein the center is located at half a distance of the height, and
    - wherein the center runs parallel with the full length of the wall plate;
  - a top;
  - a bottom;
  - a front face comprising
    - a series of vertically aligned screw holes spaced horizontally at intervals, and
    - at least one stud attachment point, allowing for variable placement of the wall plate on a wall,
    - wherein the screw holes are vertically spaced separately;
  - two angular surfaces; and
  - wherein a trapezoid geometry is formed by the two angular surfaces angled towards the center extended from the front face towards a small end, of the two angular surfaces and forming a retaining lip on both the top and bottom sides of the wall plate;
- a shelf slider comprising
  - a corresponding geometry to the wall plate, allowing the shelf slider to movably attach to the wall plate and slide along the full length of the wall plate;
  - a threaded opening extending through a width of the slider;
- a shelf extension arm that can be threaded into the threaded opening of the slider,
  - wherein a back surface of the shelf extension arm contacts the face of the wall plate, thereby pulling the corresponding geometry of the slider against the two angular surfaces of the wall plate and preventing movement of the slider.

2. The floating shelf hardware of claim 1, wherein the wall plate further comprises a protrusion extending from the small end of the two angular surfaces towards the wall, having a height that is greater than the height of the wall plate, providing increased contact surface area between the wall plate and the wall.

3. The floating shelf hardware of claim 1, wherein the wall plate is attachable to the wall using wall screws, and said wall plate is attachable to at least one stud of the wall.

4. The floating shelf hardware of claim 1, wherein the series of screw holes in the wall plate are circular in shape.

5. The floating shelf hardware of claim 1, wherein the width of the slider is at least 80% of a height of the wall plate.

6. The floating shelf hardware of claim 1, wherein the shelf extension arm is removable from the slider by unthreading the shelf extension arm from the threaded opening.

7. A floating shelf hardware comprising:
- a wall plate comprising
  - a full length;
  - a height comprising a center,
    - wherein the center is located at half a distance of the height, and
    - wherein the center runs parallel with the full length of the wall plate;
  - a top;
  - a bottom;
  - a front face comprising
    - a series of vertically aligned screw holes spaced horizontally at intervals, and
    - at least one stud attachment point, allowing for variable placement of the wall plate on a wall,
    - wherein the screw holes are vertically spaced to overlap;
  - two angular surfaces; and
  - wherein a trapezoid geometry is formed by the two angular surfaces angled towards the center extended from the front face towards a small end, of the two angular surfaces and forming a retaining lip on both the top and bottom sides of the wall plate;
- a shelf slider comprising
  - a corresponding geometry to the wall plate, allowing the shelf slider to movably attach to the wall plate and slide along the full length of the wall plate;
  - a threaded opening extending through a width of the slider;
- a shelf extension arm that can be threaded into the threaded opening of the slider,
  - wherein a back surface of the shelf extension arm contacts the face of the wall plate, thereby pulling the corresponding geometry of the slider against the two angular surfaces of the wall plate and preventing movement of the slider.

8. The floating shelf hardware of claim 7, wherein the wall plate further comprises a protrusion extending from the small end of the two angular surfaces towards the wall, having a height that is greater than the height of the wall plate, providing increased contact surface area between the wall plate and the wall.

9. The floating shelf hardware of claim 7, wherein the wall plate is attachable to the wall using wall screws, and said wall plate is attachable to at least one stud of the wall.

10. The floating shelf hardware of claim 7, wherein the series of screw holes in the wall plate are circular in shape.

11. The floating shelf hardware of claim 7, wherein the width of the slider is at least 80% of a height of the wall plate.

12. The floating shelf hardware of claim 7, wherein the slider is detachable from the wall plate by sliding the slider off from one end of the wall plate.

13. The floating shelf hardware of claim 7, wherein the shelf extension arm is removable from the slider by unthreading the shelf extension arm from the threaded opening.

* * * * *